US008914998B2

(12) United States Patent
Gheorghian et al.

(10) Patent No.: US 8,914,998 B2
(45) Date of Patent: Dec. 23, 2014

(54) SOLE ASSEMBLY FOR ARTICLE OF FOOTWEAR WITH INTERLOCKING MEMBERS

(75) Inventors: Petre Gheorghian, Portland, OR (US); Martine I. V. Mientjes, Beaverton, OR (US); Erez Morag, Lake Oswego, OR (US); Matthew A. Nurse, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 415 days.

(21) Appl. No.: 13/033,414

(22) Filed: Feb. 23, 2011

(65) Prior Publication Data

US 2012/0210606 A1 Aug. 23, 2012

(51) Int. Cl.

| | |
|---|---|
| ***A43B 13/14*** | (2006.01) |
| ***A43B 5/06*** | (2006.01) |
| ***A43B 13/12*** | (2006.01) |
| ***A43B 13/18*** | (2006.01) |

(52) U.S. Cl.

CPC ..... *A43B 13/141* (2013.01); *A43B 5/06* (2013.01); *A43B 13/127* (2013.01); *A43B 13/181* (2013.01); *A43B 13/185* (2013.01); *A43B 13/187* (2013.01)

USPC ..... 36/103; 36/44; 36/28

(58) Field of Classification Search

CPC .... A43B 13/141; A43B 13/223; A43B 13/14; A43B 13/22; A43B 13/16; A43B 13/26; A43B 13/04; A43B 13/12; A43B 13/125; A43B 13/181; A43B 13/187; A43B 5/001; A43B 13/026; A43B 3/0005; A43B 7/144; A43B 13/122

USPC ..... 36/102, 103, 25 R, 28, 30 R, 31, 32 R, 36/59 R, 3 R

See application file for complete search history.

(56) References Cited

U.S. PATENT DOCUMENTS

| | | | | | |
|---|---|---|---|---|---|
| 2,527,414 | A | * | 10/1950 | Hallgren | 36/32 R |
| 2,930,149 | A | * | 3/1960 | Hack et al. | 36/28 |
| 3,087,261 | A | * | 4/1963 | Russell | 36/28 |
| 3,087,262 | A | * | 4/1963 | Russell | 36/28 |
| 3,172,217 | A | * | 3/1965 | Colman | 36/28 |
| 4,012,855 | A | | 3/1977 | Gardner | |
| 4,021,855 | A | * | 5/1977 | Czonka et al. | 360/69 |
| 4,041,618 | A | | 8/1977 | Famolare, Jr. | |
| 4,044,479 | A | * | 8/1977 | Brutting | 36/32 R |
| 4,245,406 | A | * | 1/1981 | Landay et al. | 36/14 |
| 4,358,902 | A | | 11/1982 | Cole et al. | |
| 4,546,556 | A | | 10/1985 | Stubblefield | |
| 4,638,577 | A | * | 1/1987 | Riggs | 36/114 |

(Continued)

*Primary Examiner* — Clinton T Ostrup
*Assistant Examiner* — Catherine M Ferreira
(74) *Attorney, Agent, or Firm* — Plumsea Law Group, LLC

(57) ABSTRACT

An article of footwear includes a sole assembly with a rib that is resiliently flexible, and the rib has a longitudinal axis and a transverse axis. The transverse axis extends at an acute angle relative to the ground surface, and the rib includes a first longitudinal end, a second longitudinal end, and a middle portion disposed between the first and second longitudinal ends. A height of the first and/or second longitudinal end is greater than that of the middle portion. The rib is operable to axially support a first force applied substantially along the acute angle relative to the ground surface, and the rib transverse axis remains substantially straight in response to the first force. The rib resiliently bends about the rib longitudinal axis in response to a second force applied substantially normal to the ground surface to make the rib transverse axis non-linear.

20 Claims, 5 Drawing Sheets

(56) References Cited

U.S. PATENT DOCUMENTS

| | | | | |
|---|---|---|---|---|
| 5,375,346 | A | 12/1994 | Cole et al. | |
| 5,713,140 | A * | 2/1998 | Baggenstoss | 36/28 |
| 5,842,291 | A | 12/1998 | Schmidt et al. | |
| 6,305,100 | B1 * | 10/2001 | Komarnycky et al. | 36/3 R |
| 7,281,343 | B2 * | 10/2007 | Riha et al. | 36/59 C |
| 7,290,357 | B2 * | 11/2007 | McDonald et al. | 36/102 |
| 7,467,484 | B2 * | 12/2008 | Chang et al. | 36/30 R |
| 7,644,521 | B2 | 1/2010 | McCarron | |
| 7,703,221 | B2 * | 4/2010 | Richards et al. | 36/59 R |
| 8,151,485 | B2 * | 4/2012 | Hurd et al. | 36/27 |
| 2010/0186265 | A1 * | 7/2010 | Evans et al. | 36/36 R |
| 2010/0192415 | A1 * | 8/2010 | James | 36/103 |
| 2013/0019499 | A1 * | 1/2013 | Hsu | 36/44 |

* cited by examiner

SOLE ASSEMBLY FOR ARTICLE OF FOOTWEAR WITH INTERLOCKING MEMBERS

FIELD

The present disclosure relates to an article of footwear and, more particularly, relates to a sole assembly for an article of footwear that includes interlocking members.

BACKGROUND

Articles of footwear can include an upper and a sole assembly. The upper can include layers or sections of material that wrap about and cover a substantial portion of the wearer's foot and ankle. The upper can also include laces, straps, or the like for securing the footwear to the wearer's foot. The sole assembly can include an outsole and a midsole. The outsole can be a unitary piece of relatively high-friction material that provides traction. The midsole can include foam that is disposed between the outsole and the upper for providing cushioned support for the wearer.

However, there remains a need for an article of footwear that is more versatile such that the footwear provides adequate support during a wide variety of activities. Also, there remains a need for an article of footwear that can be comfortable enough to wear while walking and standing during long periods of time and that also provides a sufficiently stiff surface for pushing off while thrusting the foot forward. Furthermore, there remains a need for an article of footwear that provides sufficient stability in these various situations.

SUMMARY

Accordingly, despite the improvements of known devices described above, there remains a need for an article of footwear for treading on a ground surface. The footwear includes an upper and a sole assembly that is operably coupled to the upper. The sole assembly includes a rib that is resiliently flexible, and the rib has a rib longitudinal axis and a rib transverse axis. The rib transverse axis extends at an acute angle relative to the ground surface, and the rib includes a first longitudinal end, a second longitudinal end, and a middle portion disposed between the first and second longitudinal ends. A height of at least one of the first and second longitudinal ends measured along the rib transverse axis is greater than that of the middle portion. The rib is operable to axially support a first force applied substantially along the acute angle relative to the ground surface, and the rib transverse axis remains substantially straight in response to the first force. The rib resiliently bends about the rib longitudinal axis in response to a second force applied substantially normal to the ground surface to make the rib transverse axis non-linear.

Also, an article of footwear is disclosed that includes an upper and a sole assembly that is operably coupled to the upper. The sole assembly includes a resiliently flexible first member with a first base and a plurality of first ribs projecting generally inferiorly from the first base. Each first rib has a respective first rib longitudinal axis and a respective first rib transverse axis. At least one of the first rib transverse axes is disposed at an acute angle relative to the ground surface. Also, the sole assembly includes a resiliently flexible second member with a second base and a plurality of second ribs projecting generally superiorly from the second base. Each second rib has a respective second rib longitudinal axis and a respective second rib transverse axis. At least one of the second rib transverse axes is disposed substantially at the acute angle relative to the ground surface. Moreover, at least one of the second ribs includes a longitudinal end and a middle portion. A height of the longitudinal end measured along the respective second rib transverse axis is greater than that of the middle portion. Furthermore, at least some of the second ribs are received between respective pairs of the plurality of first ribs to axially support a first force applied substantially along the acute angle relative to the ground surface and to resiliently bend about the respective rib longitudinal axis in response to a second force applied generally normal to the ground surface. At least some of the second rib transverse axes remain substantially straight in response to the first force, and these second rib transverse axes are non-linear in response to the second force.

Still further, an article of footwear for treading on a ground surface having an anterior end, a posterior end, a lateral side, a medial side, and a footwear longitudinal axis is disclosed. The article of footwear includes an upper, an outsole, and a midsole assembly that is operably coupled to the upper and the outsole. The midsole assembly includes a resiliently flexible first member with a first base and a plurality of first ribs integrally coupled to and projecting generally inferiorly from the first base. Each first rib has a respective first rib longitudinal axis extending substantially perpendicular to the footwear longitudinal axis. Each first rib also has a respective first rib transverse axis that extends at an acute angle relative to the ground surface. The midsole assembly further includes a resiliently flexible second member with a second base and a plurality of second ribs integrally coupled to and projecting generally superiorly from the second base. Each second rib has a respective second rib longitudinal axis and a respective second rib transverse axis that extends substantially at the acute angle relative to the ground surface. Each second rib has a first longitudinal end, a second longitudinal end, and a middle portion between the first and second longitudinal ends. A height of the first and second longitudinal ends measured along the respective second rib transverse axis is greater than that of the respective middle portion. Also, the second base and the plurality of second ribs are more resistant to resilient deformation than the first base and the plurality of first ribs. The plurality of second ribs are alternatingly and interlockingly arranged in sequence with the plurality of first ribs from the anterior end to the posterior end to axially support a first force applied substantially along the acute angle relative to the ground surface and to resiliently bend about the respective rib longitudinal axis in response to a second force applied substantially normal to the ground surface. At least some of the second rib transverse axes remain substantially straight in response to the first force, and these second rib transverse axes are non-linear in response to the second force.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
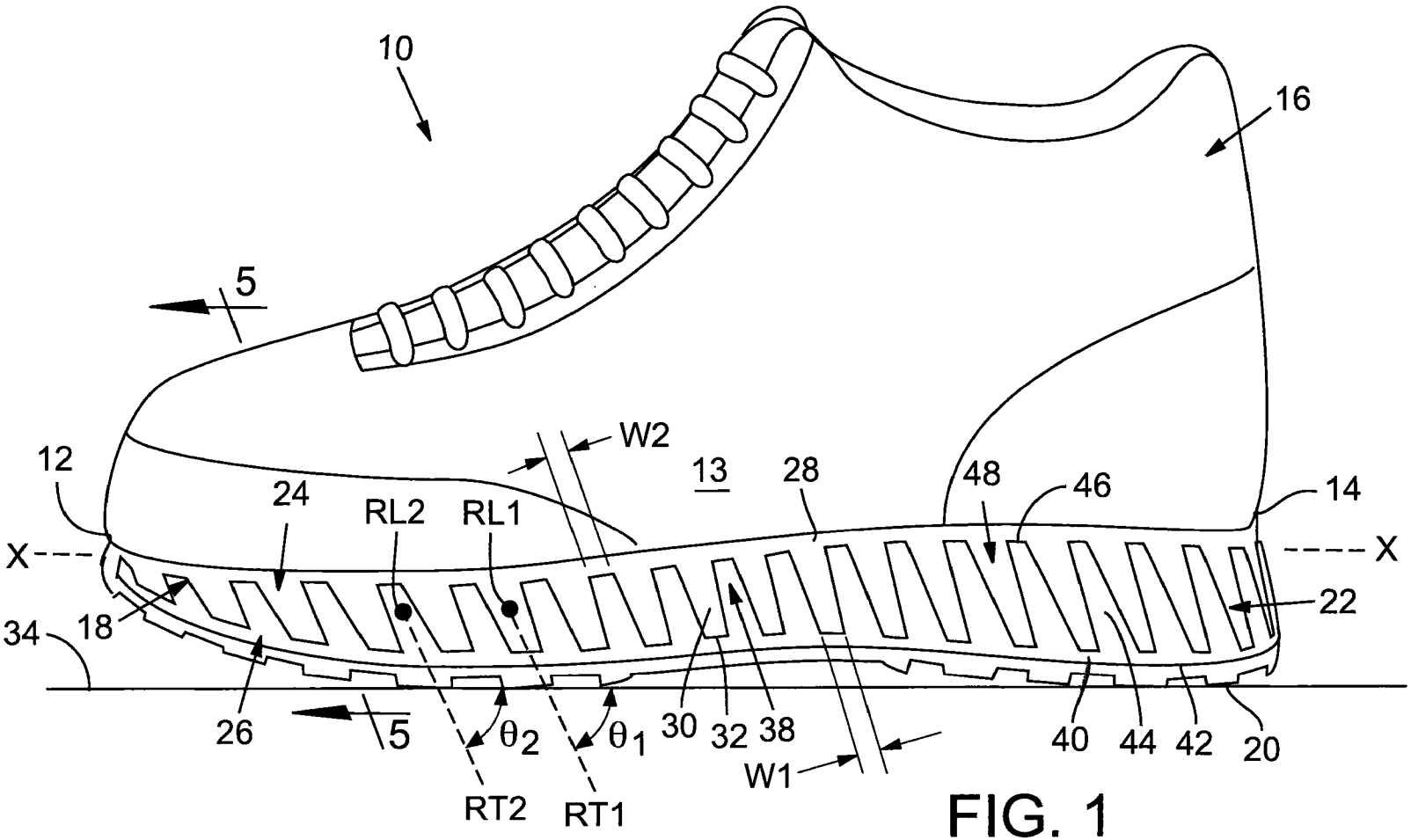
FIG. 1 is a side view of an article of footwear according to various exemplary embodiments of the present disclosure.
Figure 2:
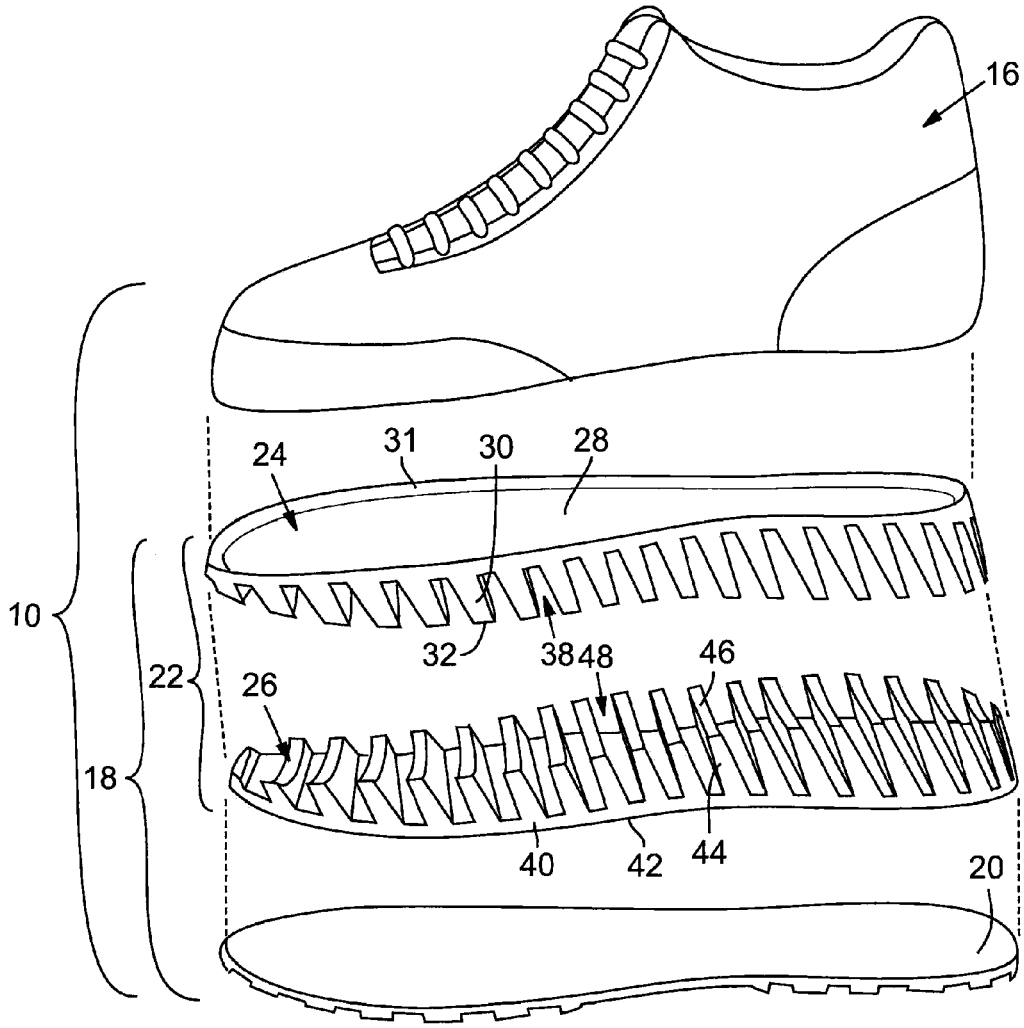
FIG. 2 is an exploded side view of the article of footwear of FIG. 1.

Referring to FIGS. 1 and 2, an article of footwear 10 is illustrated according to various exemplary embodiments of the present disclosure. The article of footwear 10 can fit about and support a foot 11 (FIG. 5) of a wearer for treading on a ground surface 34.

Figure 5:
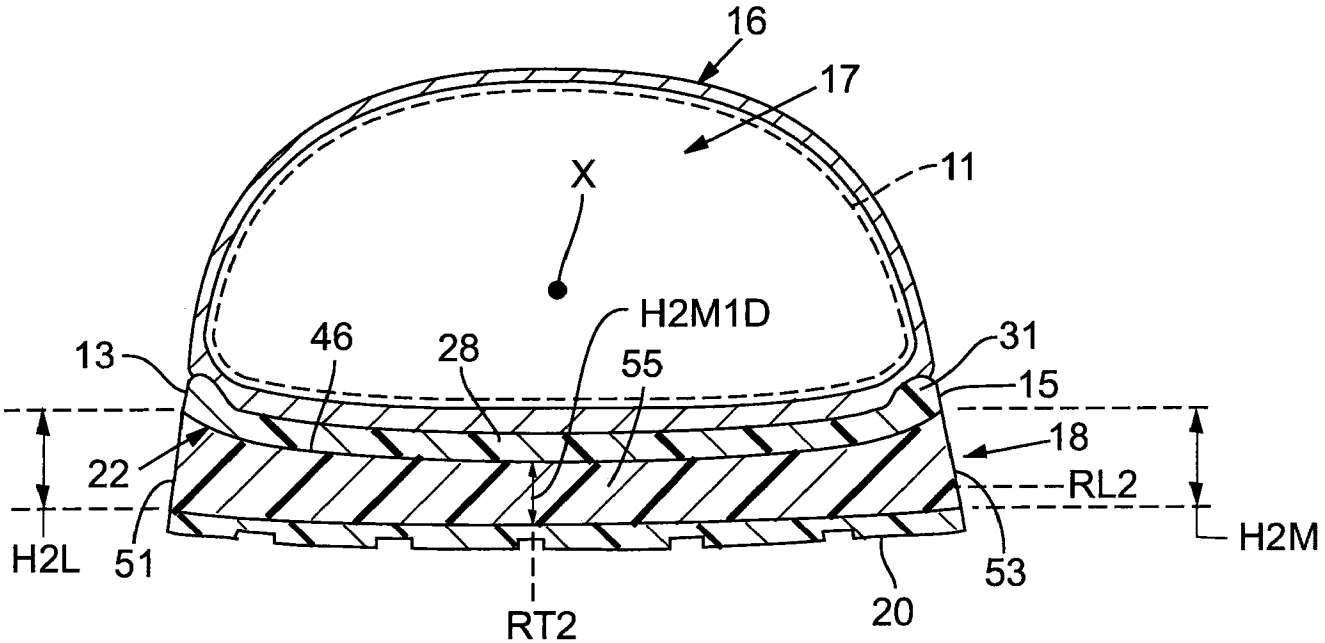
FIG. 5 is a section view of the article of footwear taken along the line 5-5 of FIG. 1.

As shown in FIGS. 1 and 5, the article of footwear 10 can define an anterior end 12, a posterior end 14, a lateral side 13, and a medial side 15. Also, the footwear 10 can have a longitudinal axis X extending between the anterior and posterior ends 12, 14. As shown, the footwear 10 can be a shoe (e.g., an athletic shoe); however, it will be appreciated that the footwear 10 could be of any suitable type other than a shoe, such as a sandal, boot, and the like without departing from the scope of the present disclosure. Also, although the footwear 10 is illustrated for a left foot 11 of a wearer, it will be appreciated that the footwear 10 can be adapted for a right foot of a wearer without departing from the scope of the present disclosure.

The article of footwear 10 can include an upper 16. The upper 16 can include one or more panels that are overlapped and interconnected to define a cavity 17 (FIG. 5) that receives the foot of the wearer. Also, the upper 16 can include laces, buckles, pile tape, or other suitable types of means of securing the upper 16 to the foot.

In addition, the article of footwear 10 can include a sole assembly 18 as shown in detail in FIG. 2. The sole assembly 18 can generally include an outsole 20 and a midsole assembly 22. Both the outsole and midsole assembly 20, 22 can be operably coupled to the upper 16. More specifically, the midsole assembly 22 can be disposed between the outsole 20 and the upper 16.

Generally, the outsole 20 can include one or more pieces of high-friction material, such as rubber, and can include various tread patterns, grooves, or other features for improving traction of the footwear 10. Also, the midsole assembly 22 can generally include a first member 24 (FIG. 3) and a second member 26 (FIG. 4). The first member 24 can be disposed between the second member 26 and the upper 16, and the second member 26 can be disposed between the first member 24 and the outsole 20. In some embodiments, the outsole 20 can be fixed only to the second member 26. In other embodiments, the outsole 20 can be fixed to the second member 26 and the first member 24. In still other embodiments, the outsole 20 can extend in a superior direction to fix partially to the upper 16 as well.

Both the first and second members 24, 26 of the midsole assembly 22 can be made of or include resiliently flexible material, such as foam. In some embodiments, the first and second members 24, 26 can be made from different materials, and either of the members 24, 26 can be stiffer than the other. In other embodiments, the first and/or second members 24, 26 can include fluid-filled bladders that are resiliently deformable. As such, the first and second members 24, 26 can provide cushioned support for the foot 11.

The first and second members 24, 26 can be formed in any suitable fashion, such as molding processes. Also, in some embodiments, the members 24, 26 can be formed independently. In other embodiments, the members 24, 26 can be formed in a dual injection-molding method, wherein one of the members 24, 26 is formed first, then introduced into a mold, and then the other member 24, 26 is molded around the previously formed member 24, 26. (The dual injection-molding method of the members 24, 26 can be according to the teachings discussed in U.S. Pat. No. 7,467,484, issued Dec. 23, 2008, U.S. patent application Ser. No. 12/552,790, filed Sep. 2, 2009, U.S. patent application Ser. No. 12/552,778, filed Sep. 2, 2009, U.S. Patent Publication No. 2010/0098797, published Apr. 22, 2010, and U.S. Patent Publication No. 2010/0287788, published Nov. 18, 2010, each of which is hereby incorporated by reference in its entirety.) In still other embodiments, the first and/or second members 24, 26 can be formed not by molding methods, but instead by removing (e.g., cutting) material from a blank of material.

The first member 24 will now be discussed in greater detail with reference to FIGS. 1 and 3. As shown, the first member 24 can generally include a base 28. The base 28 can be plate-shaped and can include a substantially flat superior surface 29. The base 28 can also include a raised, contoured superior peripheral edge 31. The raised superior peripheral edge 31 can help center the foot 11 toward the longitudinal axis X (FIG. 5) as will be discussed.

Figure 3:
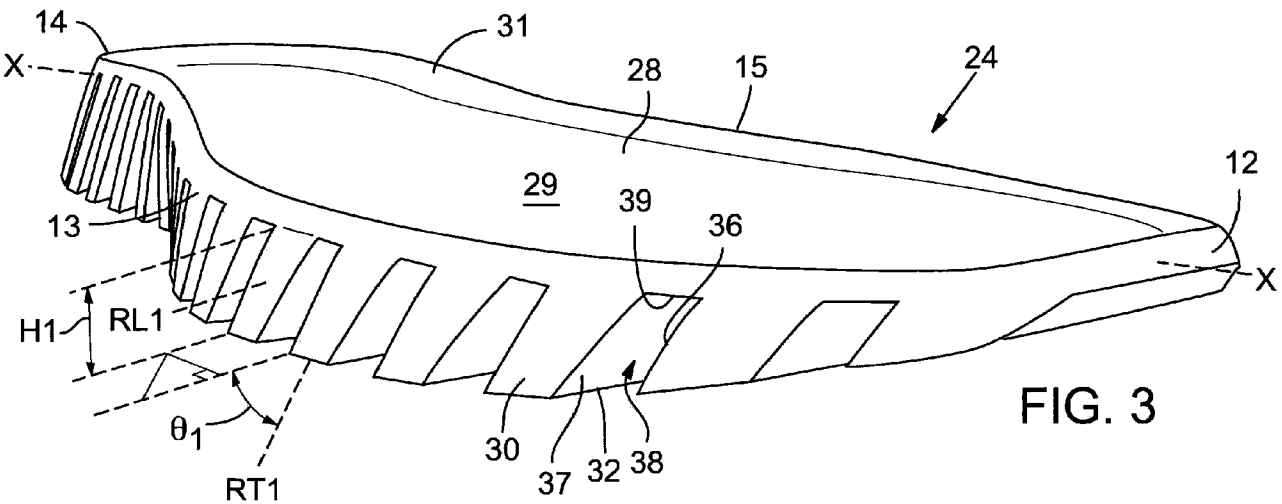
FIG. 3 is an isometric front view of a first member of a sole assembly of the article of footwear of FIG. 1.
Figure 4:
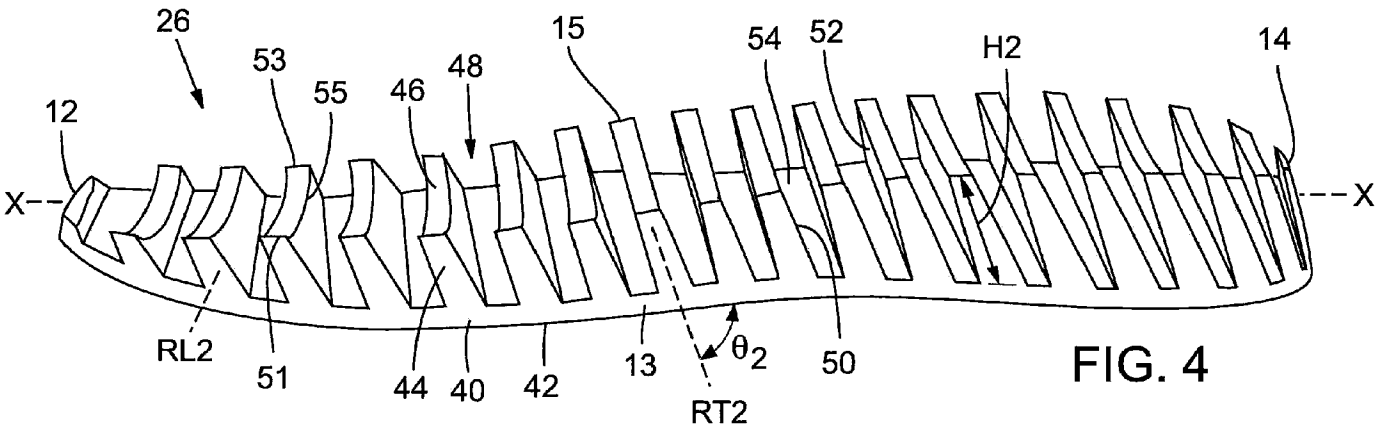
FIG. 4 is an isometric side view of a second member of a sole assembly of the article of footwear of FIG. 1.

As shown in FIG. 3, the first member 24 can also include a plurality of first ribs 30. Each rib 30 can generally extend inferiorly and posteriorly from the base 28 and terminate at a respective inferior surface 32. The inferior surfaces 32 can each be substantially flat. Moreover, the ribs 30 can be spaced apart at a distance in the anterior-posterior direction. As such, a groove 38 can be defined between respective pairs of the ribs 30. The groove 38 can be defined by a respective anterior surface 36, a respective posterior surface 37, and an interior surface 39 (FIG. 3). Each of the anterior surfaces 36, the posterior surfaces 37, and the interior surfaces 39 can be substantially flat. The interior surfaces 39 can each be substantially parallel to the superior surface 29 of the base 28. It will be appreciated, however, that any of the inferior surfaces 32, the anterior surfaces 36, the posterior surfaces 37, and/or the interior surfaces 39 can be contoured without departing from the scope of the present disclosure.

The ribs 30 can be integrally coupled to the base 28 so as to be monolithic; however, in other embodiments, the ribs 30 can be removably coupled to the base 28. In still other embodiments, the first member 24 can include one or more of the ribs 30, and the base 28 is not included.

Each rib 30 can be elongate so as to define a respective first rib longitudinal axis RL1 (FIGS. 1 and 3). Each first rib longitudinal axis RL1 can be substantially straight and can extend between the medial and lateral sides 13, 15. More specifically, each first rib longitudinal axis RL1 can be substantially perpendicular to the longitudinal axis X of the footwear 10. It will be appreciated, however, that the first rib longitudinal axis RL1 can be curved in some embodiments.

Also, it will be appreciated that the first rib longitudinal axis RL1 can extend in any suitable direction and to any suitable area of the footwear 10.

As shown in FIGS. 1 and 3, each rib 30 can also define a respective first rib transverse axis RT1. Each first rib transverse axis RT1 can be substantially straight and perpendicular to the respective first rib longitudinal axis RL1. Because the ribs 30 depend inferiorly and posteriorly, the first rib transverse axis RT1 can be disposed at an acute first angle θ1 relative to the ground surface 34. The acute angle θ1 can have any suitable value, such as an angle between 45 degrees and 75 degrees. In some embodiments, each rib 30 can extend at approximately the same acute angle θ1. It will be appreciated, however, that the first rib transverse axis RT1 can be curved in some embodiments, and the first acute angle θ1 can be defined from a tangent of the transverse axis RT1. Also, it will be appreciated that the first rib transverse axis RT1 can extend in any suitable direction and to any suitable area of the footwear 10.

As shown in FIG. 1, each rib 30 can also have a respective first width W1. In the embodiments illustrated, the first width W1 can vary along the respective first rib transverse axis RT1. For instance, in some embodiments, the first width W1 can taper gradually along the first rib transverse axis RT1 such that the first width W1 is larger adjacent the base 28 as compared to the first width W1 adjacent the inferior surface 32.

Still further, as shown in FIG. 3, each rib 30 can have a respective first height H1. The first height H1 can be measured from the base 28 to the respective inferior surface 32 along the respective first rib transverse axis RT1. As shown, the first height H1 of each rib 30 can vary depending on its respective location on the footwear 10. For instance, the ribs 30 closer to the posterior end 14 can be longer (i.e., can have a greater respective first height H1) than the ribs 30 closer to the anterior end 12.

The ribs 30 can be arranged sequentially and consecutively from the anterior end 12 to the posterior end 14 of the footwear 10. Thus, the first longitudinal axes RL1 can each be substantially parallel to each other, and the first transverse axes RT1 can each be substantially parallel to each other. However, it will be appreciated that the ribs 30 can be arranged in any suitable fashion. For instance, the ribs 30 can be arranged only on the forefoot area of the footwear 10 or on any other portion of the footwear 10.

The second member 26 will now be discussed in greater detail with reference to FIGS. 1 and 4. As shown, the second member 26 can generally include a base 40. The base 40 can be plate-shaped and can include a substantially flat inferior surface 42 to which the outsole 20 is attached (see FIG. 1).

As shown in FIG. 4, the second member 26 can also include a plurality of second ribs 44. Each rib 44 can generally extend superiorly and anteriorly from the base 40 and terminate at a respective superior surface 46. The superior surfaces 46 can each be contoured as will be discussed in greater detail below.

Moreover, the ribs 44 can be spaced apart at a distance in the anterior-posterior direction. As such, a groove 48 can be defined between respective pairs of the ribs 44. The groove 48 can be defined by a respective anterior surface 50, a respective posterior surface 52, and an interior surface 54 (FIG. 4). Each of the anterior surfaces 50, the posterior surfaces 52, and the interior surfaces 54 can be substantially flat. The interior surfaces 54 can each be substantially parallel to the inferior surface 42 of the base 40. It will be appreciated, however, that any of the anterior surfaces 50, the posterior surfaces 52, and/or the interior surfaces 54 can be contoured without departing from the scope of the present disclosure.

The ribs 44 can be integrally coupled to the base 40 so as to be monolithic; however, in other embodiments, the ribs 44 can be removably coupled to the base 40. In still other embodiments, the second member 26 can include one or more of the ribs 44, and the base 40 is not included.

Each rib 44 can be elongate so as to define a respective second rib longitudinal axis RL2 (FIGS. 1 and 4). Each second rib longitudinal axis RL2 can be substantially straight and can extend between the medial and lateral sides 13, 15. More specifically, each second rib longitudinal axis RL2 can be substantially perpendicular to the longitudinal axis X of the footwear 10. It will be appreciated, however, that the second rib longitudinal axis RL2 can be curved in some embodiments. Also, it will be appreciated that the second rib longitudinal axis RL2 can extend in any suitable direction and to any suitable area of the footwear 10.

As shown in FIGS. 1 and 4, each rib 44 can also define a respective second rib transverse axis RT2. Each second rib transverse axis RT2 can be substantially straight and perpendicular to the respective second rib longitudinal axis RL2. Because the ribs 44 depend superiorly and anteriorly, the second rib transverse axis RT2 can be disposed at a second acute angle θ2 relative to the ground surface 34. The second acute angle θ2 can have any suitable value, such as an angle between 45 degrees and 75 degrees. In some embodiments, each rib 44 can extend at approximately the same second acute angle θ2. Also, in some embodiments, the second angle θ2 can be approximately equal to the first angle θ1 of the first ribs 30. It will be appreciated, however, that the second rib transverse axis RT2 can be curved in some embodiments, and the second angle θ2 can be defined from a tangent of the transverse axis RT2. Also, it will be appreciated that the second rib transverse axis RT2 can extend in any suitable direction and to any suitable area of the footwear 10.

As shown in FIG. 1, each second rib 44 can also have a respective second width W2. In the embodiments illustrated, the second width W2 can vary along the respective second rib transverse axis RT2. For instance, in some embodiments, the second width W2 can taper gradually along the second rib transverse axis RT2 such that the second width W2 is larger adjacent the base 40 as compared to the second width W2 adjacent the superior surface 46.

Still further, as shown in FIG. 4, each rib 44 can have a respective second height H2. The second height H2 can be measured from the base 40 to the respective superior surface 46 along the respective second rib transverse axis RT2. As shown, the second height H2 of each rib 44 can vary depending on its respective location on the footwear 10. For instance, the majority of the ribs 44 closer to the posterior end 14 can be longer (i.e., can have a greater respective second height H2) than the ribs 44 closer to the anterior end 12.

Also, the height H2 of one or more second ribs 44 can vary across the respective rib longitudinal axis RT2 as shown in FIGS. 2, 4, and 5. For instance, as shown in FIG. 5, the second rib(s) 44 can include a lateral longitudinal end 51, a medial longitudinal end 53, and a middle portion 55 disposed between the longitudinal ends 51, 53, and the height H2L of the lateral longitudinal end 51 and the height H2M of the medial longitudinal end 53 can be greater than the height H2MID of the middle portion 55. As shown, the superior surface 46 of the second ribs 44 can be gradually contoured between the medial longitudinal end 53 and the middle portion 55 and between the lateral longitudinal end 51 and the middle portion 55. The amount of contour can vary among the different second ribs 44. For instance, the amount of contour can depend on the particular location of the second rib 44 within the footwear 10. Also, it will be appreciated that the height H2 of the second ribs 44 can vary in any suitable manner across the respective rib longitudinal axis RT2.

The ribs 44 can be arranged sequentially and consecutively from the anterior end 12 to the posterior end 14 of the footwear 10. Thus, the second longitudinal axes RL2 can each be substantially parallel to each other, and the second transverse axes RT2 can each be substantially parallel to each other. However, it will be appreciated that the ribs 44 can be arranged in any suitable fashion. For instance, the ribs 44 can be arranged only on the forefoot area of the footwear 10 or on any other portion of the footwear 10.

Additionally, the second ribs 44 of the second member 26 can be interlocked or meshed with the first ribs 30 of the first member 24 as shown in FIG. 1. The first and second ribs 30, 44 can be alternatingly and interlockingly arranged in sequence from the anterior end 12 of the footwear 10 to the posterior end 14 of the footwear 10. Accordingly, the second ribs 44 can be received within respective grooves 38 defined between respective pairs of first ribs 30. Likewise, the first ribs 30 can be received within respective grooves 48 defined between respective pairs of second ribs 44. More specifically, the interlocking arrangement of the first and second members 24, 26 can be such that the anterior surfaces 36 of the first member 24 can abut, mate, and conform to respective anterior surfaces 50 of the second member 26. Likewise, the interior surfaces 39 of the first member 24 can abut, mate, and conform to respective interior surfaces 54 of the second member 26. Also, the posterior surfaces 37 of the first member 24 can abut, mate, and conform to respective posterior surfaces 52 of the second member 26.

The first and second members 24, 26 can also be operably coupled (e.g., fixed) to each other in this interlocking relationship. For instance, in some embodiments, the first and second members 24, 26 can be coupled together via an adhesive or through some other manner. In other embodiments, the first and second members 24, 26 can be held together through surface friction without the addition of adhesives or other securing means.

Because of the different surface contours, raised surfaces, and other shapes of the first and second members 24, 26, the midsole assembly 22 can closely conform to the anatomy of the foot 11 for added comfort. For instance, the raised superior peripheral edge 31 can extend continuously about the foot 11 to help center the foot 11 toward the longitudinal axis X (FIG. 5). Moreover, because the longitudinal ends 50, 52 of the second ribs 44 have an increased height H2L, H2M as compared to the middle portion H2MID, the second member 26 can further help to center the foot 11 toward the longitudinal axis X (FIG. 5).

Moreover, the first and second members 24, 26 can have different respective resistances to resilient deformation. For instance, the second member 26 can be more resistant to resilient deformation than the first member 24. Specifically, the second member 26 can be stiffer, can have a higher durometer, can be less easily compressible, etc. as compared to the first member 24. Also, in some embodiments, different portions of the second member 26 can have different respective durometers, etc. Likewise, in some embodiments, different portions of the first member 24 can have different respective durometers, etc.

Figure 6A:
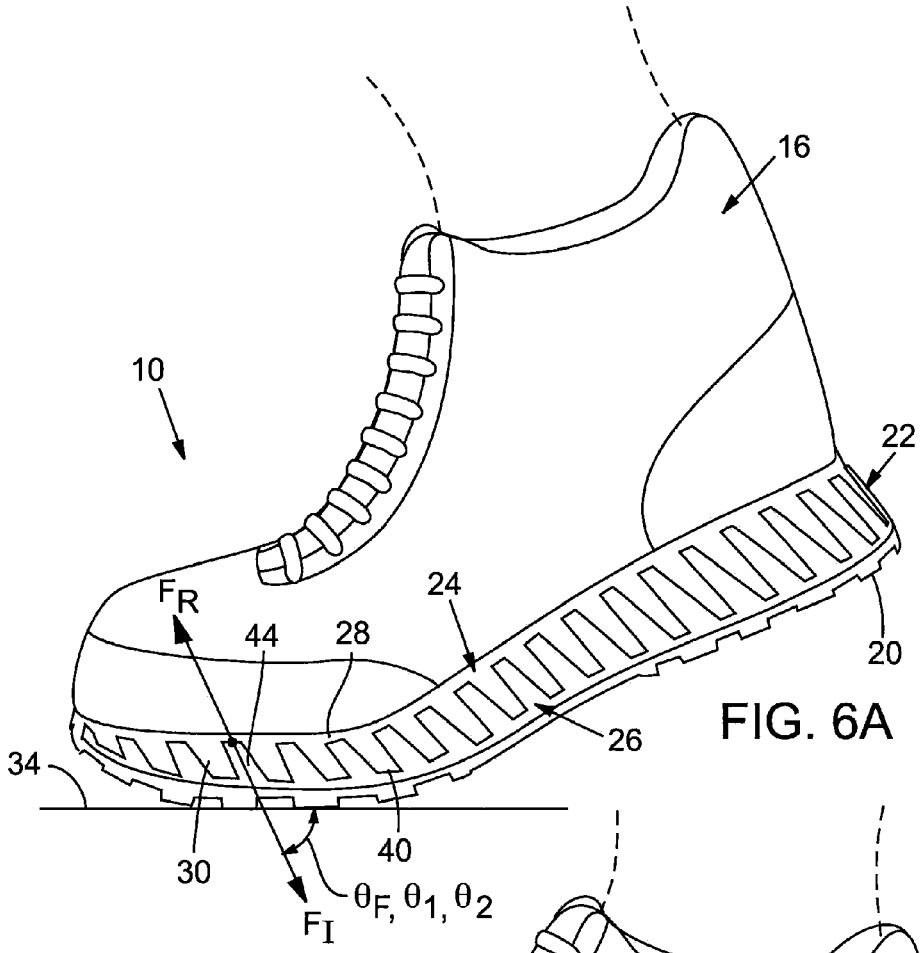
FIG. 6A is a side view of the article of footwear of FIG. 1 shown reacting to a first input force directed substantially normal to a ground surface.

Thus, operation of the midsole assembly 22 will be discussed in reference to FIGS. 6A and 6B. As shown, when the foot 11 applies an input force $F_I$ (i.e., a first force) approximately along the acute angles θ1, θ2 of the first and second ribs 30, 44 relative to the ground surface 34 (i.e., approximately parallel to the rib transverse axes RT1, RT2), the first and second ribs 30, 44 can axially support the input force $F_I$ substantially without buckling (i.e., the transverse axes RT1, RT2 can remain substantially straight). In cases where the second member 26 is stiffer (more resistant to resilient deformation) than the first member 24, the second member 26 can substantially support the input force $F_I$ and provide a reaction force $F_R$ that is substantially equal to the input force $F_I$ (i.e., the input force $F_I$ is unlikely to dissipate or be absorbed significantly because relatively little compression or deformation of the midsole assembly occurs). Thus, in the embodiment shown in FIG. 6A, when the foot 11 initially pushes off the ground surface 34 in a forward direction (e.g., before sprinting), the second member 26 can provide sufficient stiffness for achieving a strong push off force and high acceleration.

Figure 6B:
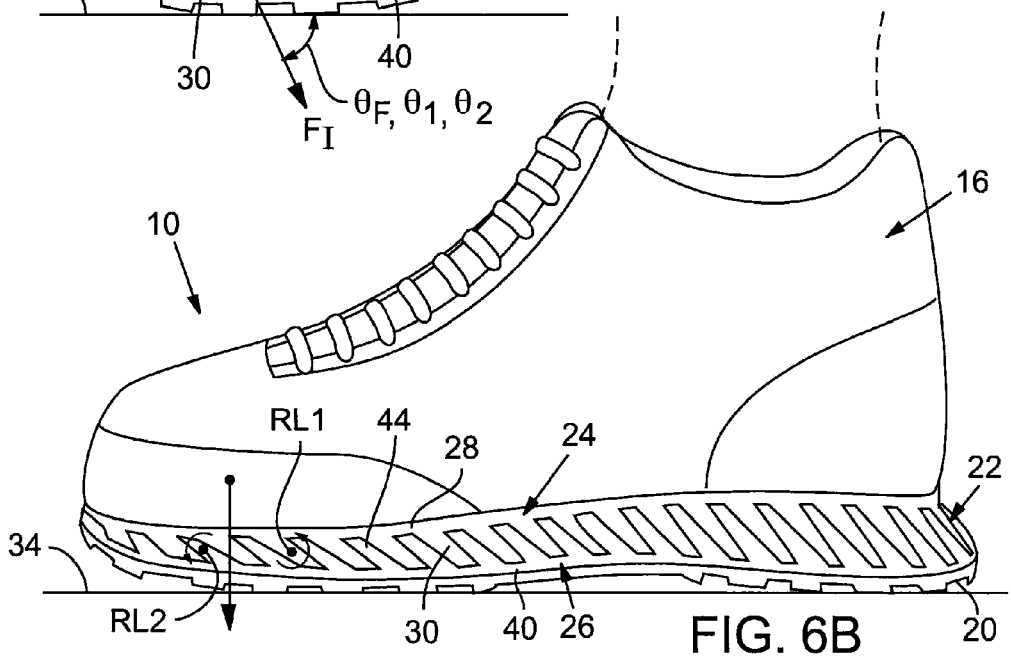
FIG. 6B is a side view of the article of footwear of FIG. 1 shown reacting to a second input force directed at an acute angle relative to the ground surface.

Also as shown in FIG. 6B, when the foot 11 applies an input force $F_S$ (i.e., a second force) directed substantially normal to the ground surface 34, the first and second ribs 30, 44 can resiliently bend about the respective rib longitudinal axes RL1, RL2 as represented by curved arrows in FIG. 6B. Specifically, the first ribs 30 can rotate and resiliently bend toward the base 28, and the second ribs 44 can rotate and resiliently bend toward the base 40. Thus, the transverse axes RT1, RT2 can curve and become non-linear. For instance, when the wearer is standing upright or walking and applying the input force $F_S$ substantially normal to the ground surface 34, the midsole assembly can compress and provide adequate cushioning for added comfort.

It will be appreciated that the ribs 30, 44 and the first and second members 26, 28 can be adapted in various ways. For instance, the ribs 30, 44 can extend longitudinally in the anterior-posterior direction such that the ribs 30, 44 are stiffer during lateral movement of the wearer.

In summary, the footwear 10 described above can be very comfortable to wear in various situations because the midsole assembly can compress a significant amount while standing, walking slowly, and the like. However, the midsole assembly can be stiffer and less compressible in other situations, such as sprinting forward such that the midsole assembly provides for higher acceleration of the wearer. Moreover, the contoured surfaces of the midsole assembly can help center the foot 11 within the footwear 10 for added stability, comfort, and performance during these various types of use.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. An article of footwear that has an anterior end, a posterior end, a medial side and a lateral side, the article of footwear comprising:

an upper; and a sole assembly that defines a ground engaging surface and that is operably coupled to the upper, wherein the sole assembly includes a first base and a second base each extending continuously between the anterior end, the posterior end, the lateral side, and the medial side, wherein the first base is exposed on the lateral side and the medial side of the article of footwear, wherein the sole assembly further includes a plurality of first ribs that are attached to the first base, the plurality of first ribs projecting generally inferiorly from the first base, the sole assembly further including a plurality of second ribs that are attached to the second base, the plurality of second ribs projecting generally superiorly from the second base, the plurality of second ribs being resiliently flexible, the plurality of second ribs each having a rib longitudinal axis that extends between the medial side and the lateral side, the plurality of second ribs each having a rib transverse axis that extends at an acute angle relative to the ground engaging surface, wherein the plurality of second ribs each include a first longitudinal end disposed adjacent the medial side, a second longitudinal end disposed adjacent the lateral side, and a middle portion that is disposed between the first and second longitudinal ends, wherein at least one of the plurality of second ribs has a height measured along the respective rib transverse axis, wherein the height of one of the first and second longitudinal ends is greater than the height measured at the respective middle portion, wherein at least two of the second ribs extend at different acute angles from each other, at least some of the first and second ribs being received between respective pairs of the other of the first and second ribs, the second base and the plurality of second ribs being more resistant to resilient deformation than the first base and the plurality of first ribs, wherein at least one of the plurality of second ribs is operable to support a first force applied substantially along the acute angle relative to the ground engaging surface, the respective rib transverse axis remaining substantially straight in response to the first force, the at least one of the plurality of second ribs resiliently bending about the respective rib longitudinal axis in response to a second force applied substantially normal to the ground engaging surface to make the respective rib transverse axis non-linear.

2. The article of footwear of claim 1, wherein the first ribs each include a first front surface and a first rear surface, wherein the first front surfaces generally face the anterior end, wherein the first rear surfaces generally face the posterior end, wherein the second ribs each include a second front surface and a second rear surface, wherein the second front surfaces generally face the anterior end, wherein the second rear surfaces generally face the posterior end, wherein the first front surfaces abut against respective ones of the second rear surfaces, and wherein the second front surfaces abut against respective ones of the first rear surfaces.

3. The article of footwear of claim 2, wherein the first ribs and the first base cooperate to define a first member, wherein the second ribs and the second base cooperate to define a second member, wherein the first member is meshed with and fixed to the second member such that there is continuous abutting contact between the first member and the second member from the anterior end to the posterior end.

4. The article of footwear of claim 1, wherein the first ribs are integrally coupled to the first base so as to be monolithic with the first base.

5. The article of footwear of claim 4, wherein the second ribs are integrally coupled to the second base so as to be monolithic with the second base.

6. The article of footwear of claim 1, wherein the first ribs extend continuously between the lateral and medial sides, wherein the first ribs are exposed on the medial side, wherein the first ribs are exposed on the lateral side, and wherein the first base is exposed on the medial side, the lateral side, the anterior end, and the posterior end.

7. The article of footwear of claim 6, wherein the article of footwear defines a footwear longitudinal axis extending between the anterior and posterior ends, and wherein the rib longitudinal axis is substantially perpendicular to the footwear longitudinal axis.

8. The article of footwear of claim 1, wherein a superior surface of at least one of the second ribs is contoured between the middle portion and at least one of the first longitudinal end and the second longitudinal end.

9. The article of footwear of claim 8, wherein the superior surface is contoured between the middle portion and the first longitudinal end, and the superior surface is contoured between the middle portion and the second longitudinal end, the respective heights of the first and second longitudinal ends being greater than the height of the middle portion.

10. The article of footwear of claim 1, wherein at least one of the second ribs has a width, and wherein the width tapers along the respective rib transverse axis.

11. An article of footwear that has a medial side and a lateral side comprising:

an upper; and a sole assembly that defines a ground engaging surface and that is operably coupled to the upper, the sole assembly including:

a resiliently flexible and unitary, one-piece first member, the first member having a first base and a plurality of first ribs projecting generally inferiorly from the first base, each first rib having a respective first rib longitudinal axis that extends between the medial side and the lateral side and a respective first rib transverse axis that extends between the upper and the ground engaging surface, at least one of the first rib transverse axes disposed at an acute angle relative to the ground engaging surface, and a resiliently flexible and unitary, one-piece second member, the second member having a second base and a plurality of second ribs projecting generally superiorly from the second base, each second rib having a respective second rib longitudinal axis that extends between the medial side and the lateral side and a respective second rib transverse axis that extends between the upper and the ground engaging surface, at least one of the second rib transverse axes disposed substantially at the acute angle relative to the ground engaging surface, wherein the first base and the plurality of first ribs are exposed on the medial side and on the lateral side of the article of footwear, wherein the second base and the plurality of second ribs are exposed on the medial side and on the lateral side, wherein each of the plurality of second ribs are interlocked between respective pairs of the plurality of first ribs, wherein the sole structure is configured to support a first force applied substantially along the acute angle relative to the ground engaging surface and a second force applied generally normal to the ground engaging surface, at least some of the second rib transverse axes remaining substantially straight in response to the first force, and the at least some of the second rib transverse axes being non-linear in response to the second force.

12. The article of footwear of claim 11, wherein the second base and the plurality of second ribs are more resistant to resilient deformation than the first base and the plurality of first ribs.

13. The article of footwear of claim 11, wherein the first ribs project from a bottom side of the first base, wherein the first base includes an upper side that is opposite the bottom side, and wherein the first base includes a raised superior peripheral edge on the upper side.

14. The article of footwear of claim 11, wherein each of the first rib longitudinal axes and second rib longitudinal axes are substantially parallel to each other.

15. The article of footwear of claim 14, wherein at least one of the plurality of first ribs and at least one of the plurality of second ribs extends continuously between the lateral and medial sides.

16. The article of footwear of claim 15, wherein the article of footwear defines a footwear longitudinal axis, and wherein the respective first rib longitudinal axes and second rib longitudinal axes are substantially perpendicular to the longitudinal axis.

17. The article of footwear of claim 11, wherein the article of footwear also defines an anterior end and a posterior end, and wherein each of the first base and the second base extends continuously between the medial side, the lateral side, the anterior end, and the posterior end.

18. The article of footwear of claim 11, wherein the article of footwear defines an anterior end and a posterior end, and wherein the plurality of first and second ribs are alternatingly and interlockingly arranged in sequence from the anterior end to the posterior end.

19. The article of footwear of claim 11, wherein at least one of the first and second ribs has a width that tapers along the respective rib transverse axis.

20. An article of footwear including an anterior end, a posterior end, a lateral side, a medial side, and a footwear longitudinal axis, the article of footwear comprising:

an upper;

an outsole that defines a ground engaging surface; and a midsole assembly that is operably coupled to the upper and the outsole, the midsole assembly including:

a resiliently flexible and unitary, one-piece first member, the first member including a first base and a plurality of first ribs integrally coupled to and projecting generally inferiorly from the first base, each first rib having a respective first rib longitudinal axis extending continuously from the medial side to the lateral side and substantially perpendicular to the footwear longitudinal axis, each first rib also having a respective first rib transverse axis that extends at a respective first acute angle relative to the ground engaging surface, the first base and each of the first ribs being exposed on the medial side and the lateral side of the article of footwear, and a resiliently flexible and unitary, one-piece second member, the second member including a second base and a plurality of second ribs integrally coupled to and projecting generally superiorly from the second base, each second rib having a respective second rib longitudinal axis extending continuously from the medial side to the lateral side, each second rib also having a respective second rib transverse axis that extends at a respective second acute angle relative to the ground engaging surface, wherein each second rib has a first longitudinal end, a second longitudinal end, and a middle portion between the first and second longitudinal ends, wherein the first longitudinal end is exposed on the medial side and the second longitudinal end is exposed on the lateral side, wherein at least one second rib has a height measured along the respective second rib transverse axis, the height being greater at the first longitudinal end than at the middle portion, the height being greater at the second longitudinal end than at the middle portion, the second base and the plurality of second ribs being more resistant to resilient deformation than the first base and the plurality of first ribs, the plurality of second ribs being alternatingly and interlockingly arranged in sequence with the plurality of first ribs from the anterior end to the posterior end, wherein at least two of the first ribs extend at different first acute angles;

wherein at least two of the second ribs extend at different second acute angles wherein the second member is configured to support a first force applied substantially along the acute angle relative to the ground engaging surface and a second force applied substantially normal to the ground engaging surface, at least some of the second rib transverse axes remaining substantially straight in response to the first force, and the at least some of the second rib transverse axes being non-linear in response to the second force.

* * * * *